US008297538B2

(12) United States Patent
Zhou

(10) Patent No.: US 8,297,538 B2
(45) Date of Patent: Oct. 30, 2012

(54) SHOWER SWITCH WITH ADJUSTABLE DEVICE

(76) Inventor: Huasong Zhou, Fujian (CN)

( * ) Notice: Subject to any disclaimer, the term of this patent is extended or adjusted under 35 U.S.C. 154(b) by 1195 days.

(21) Appl. No.: 12/126,271

(22) Filed: May 23, 2008

(65) Prior Publication Data

US 2009/0288250 A1 Nov. 26, 2009

(51) Int. Cl.
*A62C 31/00* (2006.01)

(52) U.S. Cl. ..... 239/445; 239/391; 239/394; 239/395; 239/396; 239/442; 239/443; 239/444; 239/446; 239/447; 239/448; 239/449

(58) Field of Classification Search ..... 239/394, 239/395, 391, 396, 437, 442–449, 581.1
See application file for complete search history.

(56) References Cited

U.S. PATENT DOCUMENTS

| | | | | |
|---|---|---|---|---|
| 3,801,019 | A * | 4/1974 | Trenary et al. | 239/381 |
| 4,190,207 | A * | 2/1980 | Fienhold et al. | 239/381 |
| 4,754,928 | A * | 7/1988 | Rogers et al. | 239/381 |
| 4,903,897 | A * | 2/1990 | Hayes | 239/394 |
| 5,862,985 | A * | 1/1999 | Neibrook et al. | 239/99 |
| 6,622,945 | B1 * | 9/2003 | Wu et al. | 239/443 |
| 2006/0131445 | A1 * | 6/2006 | Petrovic et al. | 239/443 |

* cited by examiner

*Primary Examiner* — Len Tran
*Assistant Examiner* — Joel Zhou

(57) ABSTRACT

The present invention pertains to a shower switch with adjustable device comprising a main body, a water divided device, a cover, a driving device and a handle. Particularly, the water divided device contains a water divided plate with water divided holes for operating with a sealing plate, which is further positioned inside the main body, and the driving device has one end thereof connecting to the sealing plate and the other end thereof pivoted to the handle. In this manner, the driving device pivoted to the main body and the handle synchronically rotates the sealing plate against the water divided plate by one hand so as to conduct the water from the sealing plate into different water divided holes for the purpose of water switching and of preventing from wetting the hands, hence increasing the convenience.

9 Claims, 4 Drawing Sheets

SHOWER SWITCH WITH ADJUSTABLE DEVICE

BACKGROUND OF THE INVENTION

1. Field of the Invention

The present invention relates to bath equipments, particularly to a shower switch with adjustable device.

2. Description of the Related Art

Typically, the shower equipment commonly guides water into different receiving cavities of the cover to spray various types of water drops from different outlet openings, such as the bobble water or massage water. The conventional shower equipment essentially makes water through the cavities and thence goes into the outlet openings via turning the cover. But the above design requires both hands to grasp the handle and simultaneously switch the cover, which may result in wetting the hands. Therefore, the conventional equipment causes the inconvenience and requires improvements.

SUMMARY OF THE INVENTION

The object of the present invention is to provide a shower switch with adjustable device conducing to have a simple operation via one hand and to prevent a direct touch of the hands.

The shower switch with adjustable device in accordance with the present invention essentially comprises a main body, a water divided device, a cover, a driving device, and a handle; wherein, the water divided device contains a water divided plate with water divided holes and a sealing plate mounted within the main body which operates with the water divided plate, and further the driving device has one end thereof connecting to the sealing plate and the other end thereof pivoted to the handle. By means of the concatenation of the elements, users merely use one hand to turn the driving device on the handle for simultaneously driving the sealing plate rotated, so as to conduct the water into the different water divided holes and form various types of water drops. Therefore the present invention prevents the hand from directly contacting the cover and streamlines the operation.

The advantages of the present invention over the known prior arts will become more apparent to those of ordinary skilled in the art by reading the following descriptions with the relating drawings.

DETAILED DESCRIPTION OF THE PREFERRED EMBODIMENTS

Figure 1:
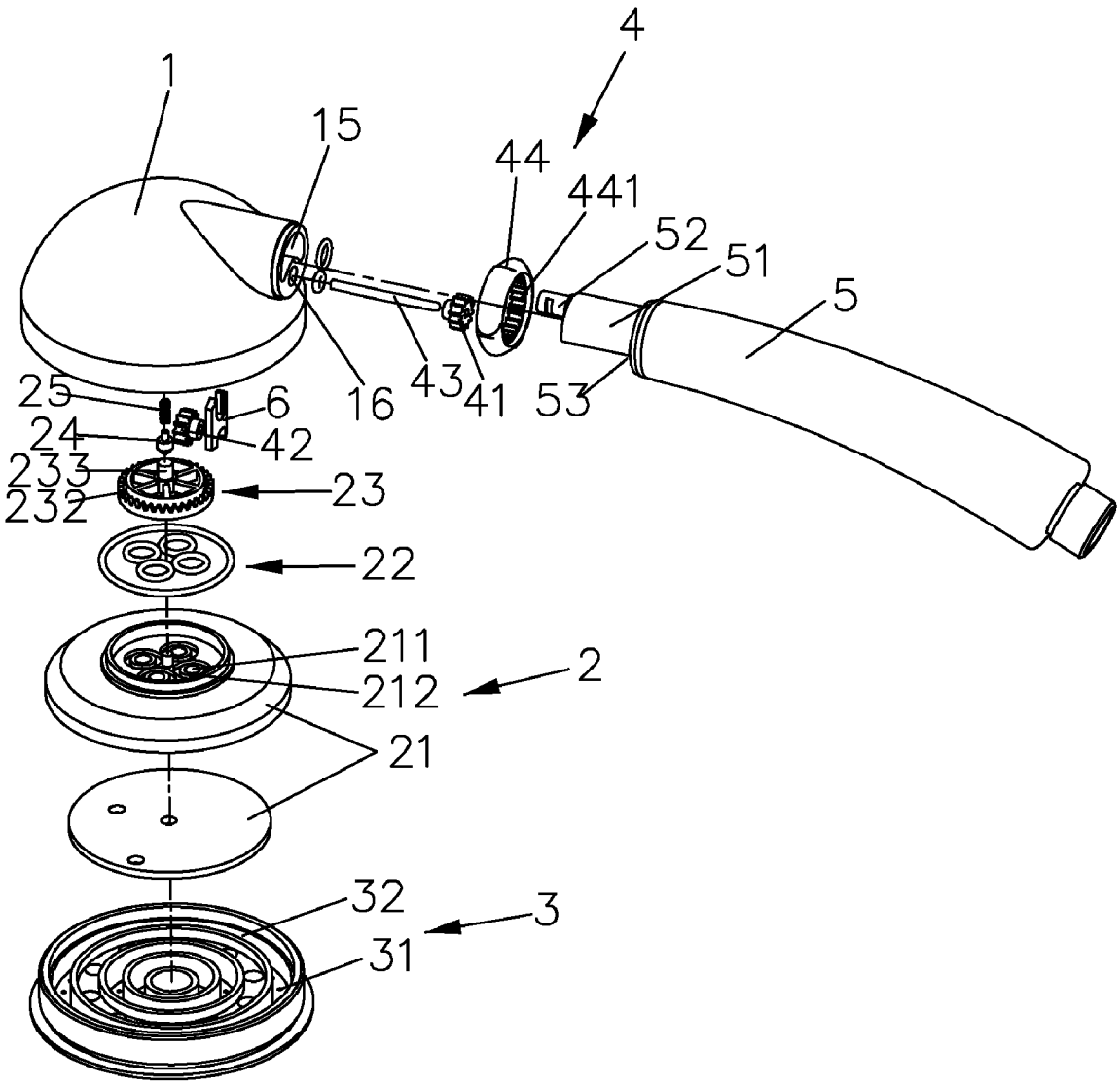
FIG. 1 is a perspective exploded view showing one preferred embodiment of the present invention.

Before the present invention is described in greater detail, it should be noted that the like elements are denoted by the same reference numerals throughout the disclosure.

Figure 1A:
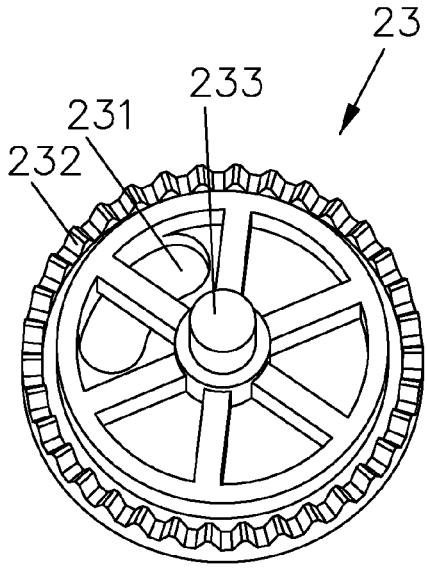
FIG. 1A is a perspective top view of the sealing plate.
Figure 1B:
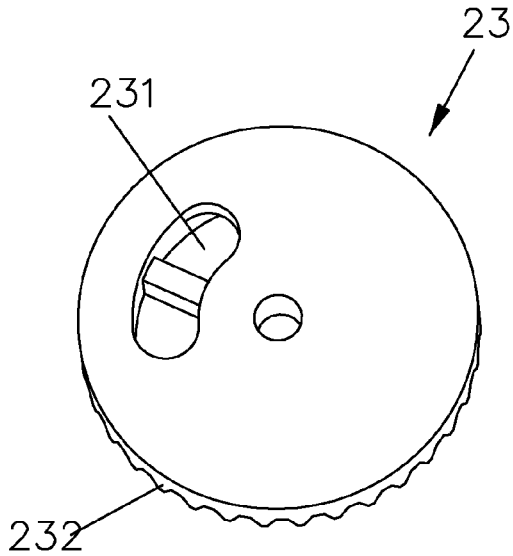
FIG. 1B is a perspective end view of the sealing plate.
Figure 2:
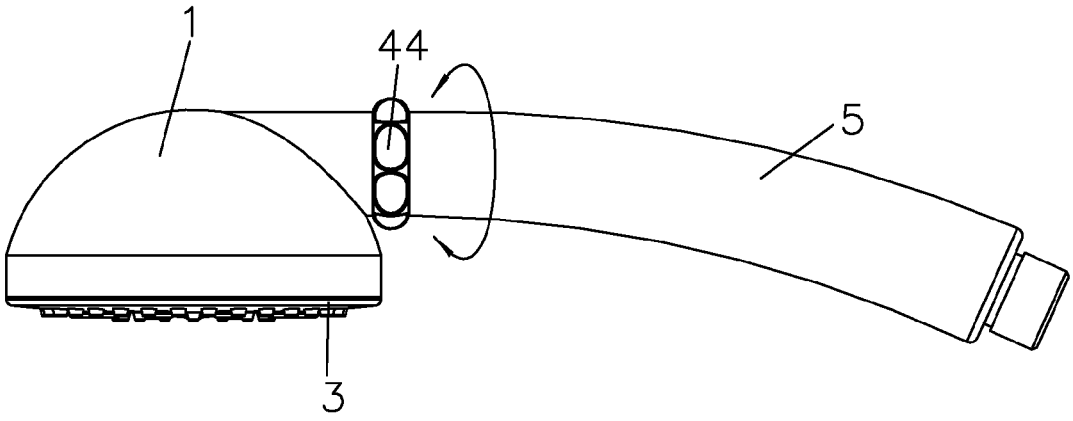
FIG. 2 is a side view showing an integral appearance of the preferred embodiment.

Referring to FIGS. 1 and 2, one preferred embodiment of the present invention comprises a main body 1, a water divided device 2, a cover 3, a driving device 4 and a handle 5 connecting to the main body 1; wherein, the main body 1 has a main cavity 11 formed thereon, a protrusion 12 disposed behind the main cavity 11, an inlet cavity 13 defined by the protrusion 12, a inlet slot 14 disposed on a bottom of the inlet cavity 13, an inlet opening 15 extended from the main body 1 and disposed perpendicular to the main cavity 11, and an aperture 16 disposed under the inlet opening 15. Additionally, the water divided device 2 is comprised of a water divided plate 21, a sealing ring 22, and a sealing plate 23. The water divided plate 21 further has a plurality of water divided holes 211 (for instance of 4 holes) respectively aim at different receiving cavities 32 performed on the cover 3 and a rib portion 212 disposed around the periphery of each water divided hole 211. Further, the sealing plate 23 (more clearly shown in FIGS. 1A and 1B) functions as a rotor and includes a sealing plate hole 231 formed on a lower surface thereof, a serrated portion 232 disposed along a periphery of an upper surface thereof, and a pillar 233 located in the center thereof. The sealing plate hole 231 herein is adopted in an arcuate contour.

Still further, the cover 3 has a plurality of outlet openings 31 interspersed throughout the front surface thereof and receiving cavities 32 formed at the rear surface thereof for being communicated with the outlet openings 31. Further, the driving device 4 includes a ring-shaped controlling member 44 disposed round the handle 5, an active gear 41 disposed against the handle 5, a passive gear 42 mounted in the main body 1 for operating with the sealing plate 23, and a transmission shaft 43 respectively connecting the active gear 41 and the passive gear 42; the controlling member 44 further has an indented surface 441 formed at the inner side thereof for synchronically driving the active gear 41. On the other hand, the handle 5 has a narrow neck 51 formed at the front side thereof and inserted into the inlet opening 15 of the main body 1, a water pipe 52 disposed in the narrow neck 52, and a free space 53 formed under the narrow neck 52 for accommodating the active gear 41.

Figure 3:
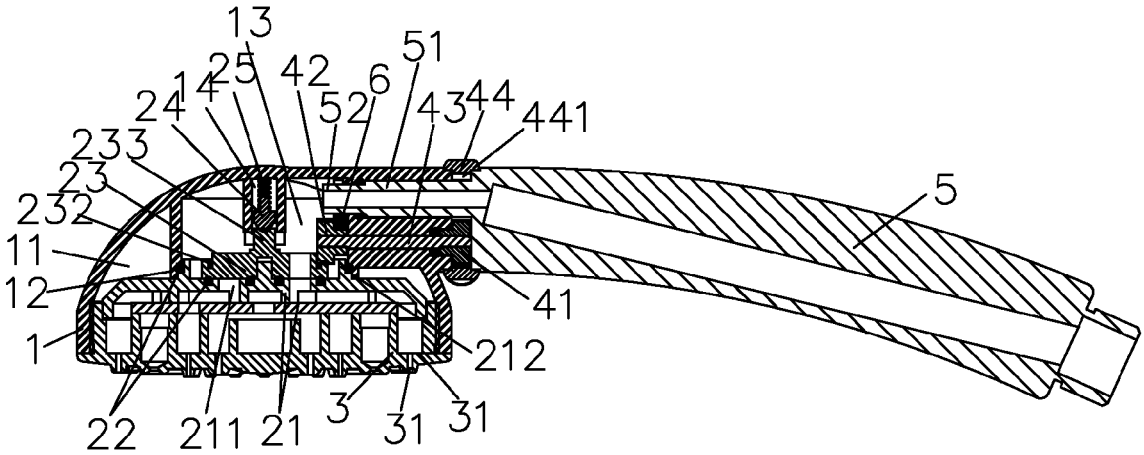
FIG. 3 is a cross-sectional view showing of FIG. 2.
Figure 4:
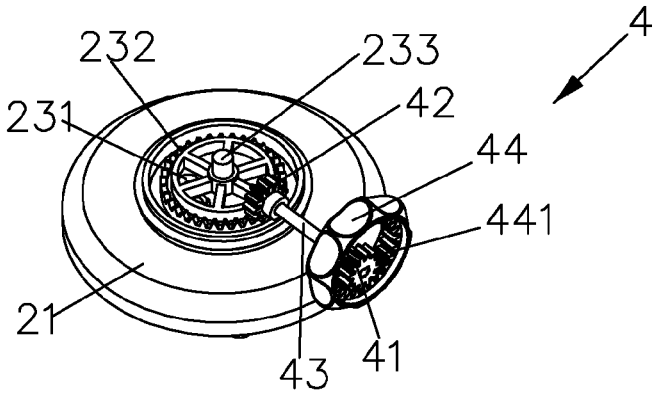
FIG. 4 is partial schematic view showing the driving device and sealing plate of the preferred embodiment.

Referring to FIGS. 2, 3 and 4, in mounting, the water divided plate 21 has its bottom fastened to the cover 3, which is then secured to the main body 1. While installing the cover 3 to the main body 1, the rib portions 212 of the sealing plate 23 contacts to the protrusion 12 of the main body 1. Further, the sealing ring 22 is mounted between the sealing plates 23 and the water divided plate 21 to prevent water from leaking out of the water divided holes 211. Accompanying with a rod 24 to be disposed against the pillar 233 of the sealing plate 23 and a spring 25 having one end thereof mounted on the rod 24 and the other end thereof extended toward the bottom of the inlet slot 14, the rod 24 and the pillar 233 are positioned within the slot 14 to confirm the firm contact of the sealing plate 23 and the water divided plate 21. Additionally, the passive gear 42 is pivoted to the sealing plate 23 for driving the serrated portion 232, and one end of the transmission shaft 43 is thence fastened to the passive gear 42, which is further restricted by a fixing plate 6 and positioned inside the main cavity 11. The other end of transmission shaft 43 passes through the aperture 16 and connects to the active gear 41 of the handle 5. When the handle 5 is installed into main body 1, the active gear 41 would fit with the indented surface 441 of the controlling member 44 and operate therewith.

Continuing with the aforementioned, while using, users simply use one hand to grasp the handle 5 and turn the controlling member 44, the active gear 41 on the controlling member 44 hence becomes rotated and simultaneously drives the passive gear 42 via the assistance of the transmission shaft 43. Subsequently, the passive gear 42 also rotate the serrated portion 232 of the sealing plate 23, so that the sealing plate hole 231 would be in communicated with any one or two water divided holes 211 of the water divided plate 21 for achieving the purpose of the water switching.

Figure 5:
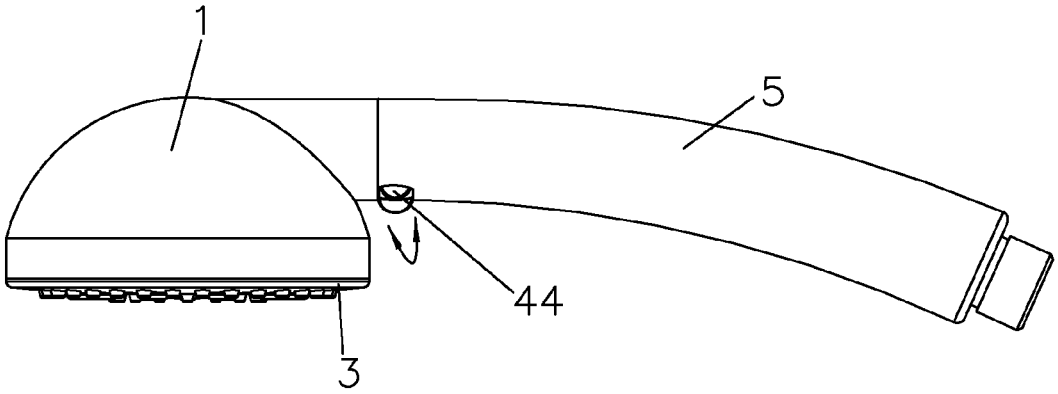
FIG. 5 is a side view showing another preferred embodiment of the present invention.
Figure 6:
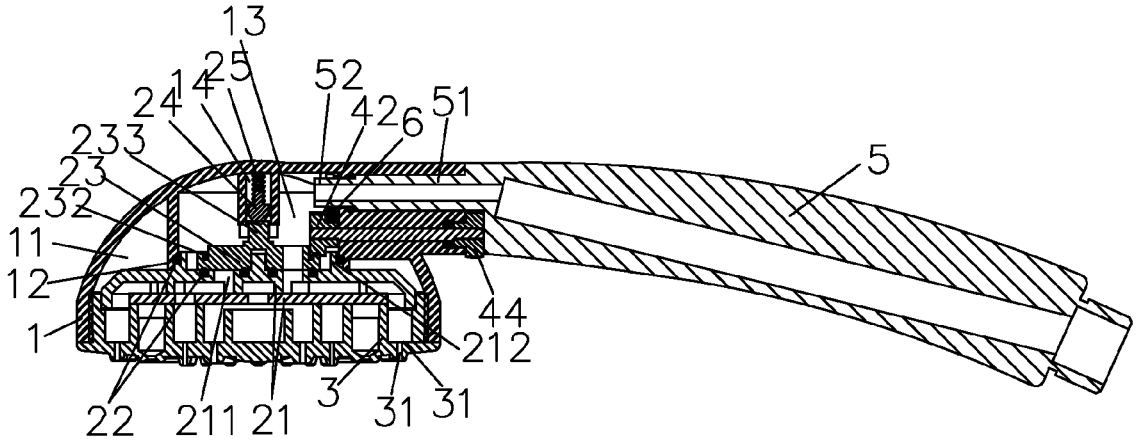
FIG. 6 is a cross-sectional view showing of FIG. 5.

Referring to FIGS. 5 and 6, another preferred embodiment of the present invention still provides with the similarly concatenation of elements and operations as same as the previous embodiment. Differently, this preferred embodiment omits the correlation of the controlling member 44 and the active gear 41, namely the active gear 41 exposes its bottom out of the handle 5 without driven by the controlling member 44, thereby allowing users to directly turn the active gear 41 via fingers and finally rotating sealing plate 23. Therefore, it prevents from wetting the hands in time of operation and more increases the using convenience.

To sum up, the present invention takes advantages of the driving device disposed on the handle and the sealing plate within the main body, users can simple use one hand to rotate the driving device and the sealing plate, thereby conducting the water through different water divided holes to achieve the purpose of the water switching.

While we have shown and described the embodiment in accordance with the present invention, it should be clear to those skilled in the art that further embodiments may be made without departing from the scope of the present invention.

I claim:

1. A shower switch with adjustable device comprising
a main body,
a water divided device, axially assembled around a pillar,
a cover,
a driving device, including
i) a transmission shaft, around which an active gear rotates, and
ii) a ring-shaped controlling member, rotatably received by an inner space of a handle, for rotating said active gear when turned by a user, and
the handle connecting to said main body;
wherein said water divided device containing a water divided plate with a plurality of water divided holes defined thereon and a sealing plate with a sealing plate hole formed thereon; said
water divided plate matching and operating with said sealing plate, which has its bottom to be positioned on said cover, and
said cover being fastened to said main body so that said sealing plate would be mounted within an inlet cavity of said main body;
said driving device having one end thereof connecting to said sealing plate and the other end thereof pivoted to said handle by passing through said main body,
an axial axis of said transmission shaft radially connected to said water divided device by orienting perpendicular to said pillar, wherein said sealing plate functions as a rotor;
said sealing plate hole is formed on a lower surface of said sealing plate, and a serrated portion is disposed along a periphery of an upper surface of said sealing plate.

2. A shower switch with adjustable device, comprising
a main body,
a water divided device, axially assembled around a pillar,
a cover,
a driving device, including
i) a transmission shaft, around which an active gear rotates, and
ii) a ring-shaped controlling member, rotatably received by an inner space of a handle, for rotating said active gear when turned by a user, and
the handle connecting to said main body;
wherein said water divided device containing a water divided plate with a plurality of water divided holes defined thereon and a sealing plate with a sealing plate hole formed thereon; said
water divided plate matching and operating with said sealing plate, which has its bottom to be positioned on said cover, and
said cover being fastened to said main body so that said sealing plate would be mounted within an inlet cavity of said main body;
said driving device having one end thereof connecting to said sealing plate and the other end thereof pivoted to said handle by passing through said main body,
an axial axis of said transmission shaft radially connected to said water divided device by orienting perpendicular to said pillar, wherein the pillar is installed in the center of said sealing plate to sustain a rod and a spring, so that said pillar is disposed between said main body and said water divided plate.

3. The shower switch with adjustable device as claimed in claim 1, wherein a pillar is installed in the center of said sealing plate to sustain a rod and a spring, so that said pillar is disposed between said main body and said water divided plate.

4. A shower switch with adjustable device, comprising
a main body,
a water divided device, axially assembled around a pillar,
a cover,
a driving device, including
i) a transmission shaft, around which an active gear rotates, and
ii) a ring-shaped controlling member, rotatably received by an inner space of a handle, for rotating said active gear when turned by a user, and
the handle connecting to said main body;
wherein said water divided device containing a water divided plate with a plurality of water divided holes defined thereon and a sealing plate with a sealing plate hole formed thereon; said
water divided plate matching and operating with said sealing plate, which has its bottom to be positioned on said cover, and
said cover being fastened to said main body so that said sealing plate would be mounted within an inlet cavity of said main body;
said driving device having one end thereof connecting to said sealing plate and the other end thereof pivoted to said handle by passing through said main body,
an axial axis of said transmission shaft radially connected to said water divided device by orienting perpendicular to said pillar, wherein said driving device provides with the active gear disposed on said handle, a passive gear located inside said main body for cooperating with said sealing plate, and the transmission shaft with one end thereof engaged to said passive gear and the other end thereof fastened to said active gear by passing through said main body.

5. The shower switch with adjustable device as claimed in claim 4, wherein, said driving device includes the ring-shaped controlling member disposed round said handle and an indented surface formed at an inner side thereof for contacting and cooperating with said active gear.

6. The shower switch with adjustable device as claimed in claim 4, wherein, a fixing plate is disposed to position said passive gear in said main body.

7. The shower switch with adjustable device as claimed in claim 5, wherein, a fixing plate is disposed to position said passive gear in said main body.

8. The shower switch with adjustable device as claimed in claim 1, wherein said main body has a main cavity formed thereon, a protrusion disposed behind said main cavity, an inlet cavity defined by said protrusion, an inlet slot disposed on a bottom of said inlet cavity, an inlet opening extended from said main body and disposed perpendicular to said main cavity, and an aperture disposed under said inlet opening.

9. The shower switch with adjustable device as claimed in claim 4, wherein, a narrow neck, formed in the front of said handle, is positioned into said main body; said narrow neck further has a water pipe disposed therein; a free space is defined under said narrow neck for accommodating said active gear.

* * * * *